US005426805A

United States Patent [19]

Fisher

[11] Patent Number: 5,426,805

[45] Date of Patent: Jun. 27, 1995

[54] WALK-BEHIND SELF-PROPELLED BROOM SWEEPER

[75] Inventor: Robert F. Fisher, Statesville, N.C.

[73] Assignee: Waldon, Inc., Fairview, Okla.

[21] Appl. No.: 111,429

[22] Filed: Aug. 24, 1993

[51] Int. Cl.[6] ..... F01H 1/02

[52] U.S. Cl. ..... 15/79.2; 15/82; 180/306

[58] Field of Search ..... 15/79.2, 82–86, 15/320, 340.3, 340.4; 51/175–177; 299/36, 39, 41; 172/329, 358, 540; 180/305, 306; 37/242, 244

[56] References Cited

U.S. PATENT DOCUMENTS

| | | | |
|---|---|---|---|
| 3,197,798 | 8/1965 | Brown et al. | 15/340.3 |
| 3,284,830 | 11/1966 | Kroll | 15/52.1 |
| 3,691,579 | 9/1972 | Kasper | 15/340.3 |
| 3,833,961 | 9/1974 | Fortman et al. | 15/340.3 |
| 3,837,029 | 9/1974 | Kasper | 15/340.3 |
| 4,674,143 | 6/1987 | Agergard et al. | 15/79.2 |
| 5,033,564 | 7/1991 | Mattson | 180/305 |

*Primary Examiner*—Edward L. Roberts, Jr.

*Attorney, Agent, or Firm*—Shlesinger Arkwright & Garvey

[57] ABSTRACT

A walk-behind self-propelled device comprises a main frame including a base portion and a handle portion; a pair of wheels secured to the base portion for engaging the ground surface; an engine mounted on the base portion; a hydraulic pump carried by the base portion and operably connected to the engine; a first hydraulic motor directly coupled to the wheels and operably connected to the hydraulic pump; an attachment secured to the base portion; a second hydraulic motor directly coupled to the attachment and operably connected to the hydraulic pump; and first and second valves for controlling the first and second hydraulic motors, respectively. Each of the first and second valves has a bypass position whereby hydraulic fluid bypasses the first and second hydraulic motors. First and second handgrips are provided for operating the first and second valves, respectively. Each of the first and second handgrips includes a non-operative position corresponding with the first and second valves being in the bypass positions and the handgrips are normally biased in the non-operative positions.

28 Claims, 5 Drawing Sheets

WALK-BEHIND SELF-PROPELLED BROOM SWEEPER

FIELD OF THE INVENTION

The present invention relates generally to a walk-behind self-propelled broom sweeper with independent direct hydraulic drives for the wheels and the broom.

BACKGROUND OF THE INVENTION

The present invention is directed to a walk-behind rotary sweeper that is unique in the industry in that it uses a direct drive for the drive wheels and the rotary broom, unlike the present practice in the industry where belt/chain, gear axle, open gear, belt drive, etc. are used, requiring relatively more maintenance. Furthermore, the present invention includes a quick change broom drive, whereas the industry uses belt, chain, sprockets, belt, etc., which would generally require more time to remove when replacing the broom wafers. In addition, the present invention is directed to a walk-behind rotary sweeper with direct, spring return valve handle controls, while the industry uses levers and cables that are relatively imprecise. The present invention is also directed to a rotary sweeper with variable wheel speed, while the industry does not incorporate such feature.

Therefore, there is a need for a walk-behind rotary sweeper with the above features that are not presently available in the industry.

OBJECTS AND SUMMARY OF THE INVENTION

It is an object of the present invention to provide a rotary sweeper that has a direct drive for the wheel drive and the broom drive, without using intermediate power transmissions such as chains, belts, sprockets, pulleys, etc.

It is another object of the present invention to provide a rotary sweeper with variable wheel speed.

It is still another object of the present invention to provide a rotary sweeper that is all hydraulic driven.

It is another object of the present invention to provide a rotary sweeper that has independent drives for the wheels and the broom.

It is yet another object of the present invention to provide a rotary sweeper that has an automatic return-to-neutral controls for wheel and broom drives and an automatic the reverse hydraulic lock on the drive wheel.

It is still another object of the present invention to provide a rotary sweeper that has hydraulic posi-traction and rachet wheels for easy turning.

It is another object of the present invention to provide a rotary sweeper that sweeps either straight ahead, to the left or to the right, by merely repositioning a simple spring loaded pin.

It is yet another object of the present invention to provide a rotary sweeper that provides relatively high tractive ability due to the machine weighing at least 450 lbs. and use of 16" diameter wheels.

It is still another object of the present invention to provide a rotary sweeper with relatively precise broom down pressure control.

It is an object of the present invention to provide a rotary sweeper that permits the right or left end of the broom as viewed from the rear or front of the machine to be adjusted up or down for positive broom bristle contact with the surface all across the broom, even if the broom wafers had worn unevenly, and/or to provide more sweeping down pressure at one end than the other end as desired.

It is another object of the present invention to provide a rotary sweeper that provides a relatively easy and quick way to remove the broom and replace worn broom wafers.

It is still another object of the present invention to provide a rotary sweeper that is modular in construction such that the broom attachment can relatively easily be removed and replaced with another attachment.

These and other objects of the present invention will become apparent from the following detailed description.

BRIEF DESCRIPTIONS OF THE DRAWINGS

DETAILED DESCRIPTION OF THE INVENTION

Figure 1:
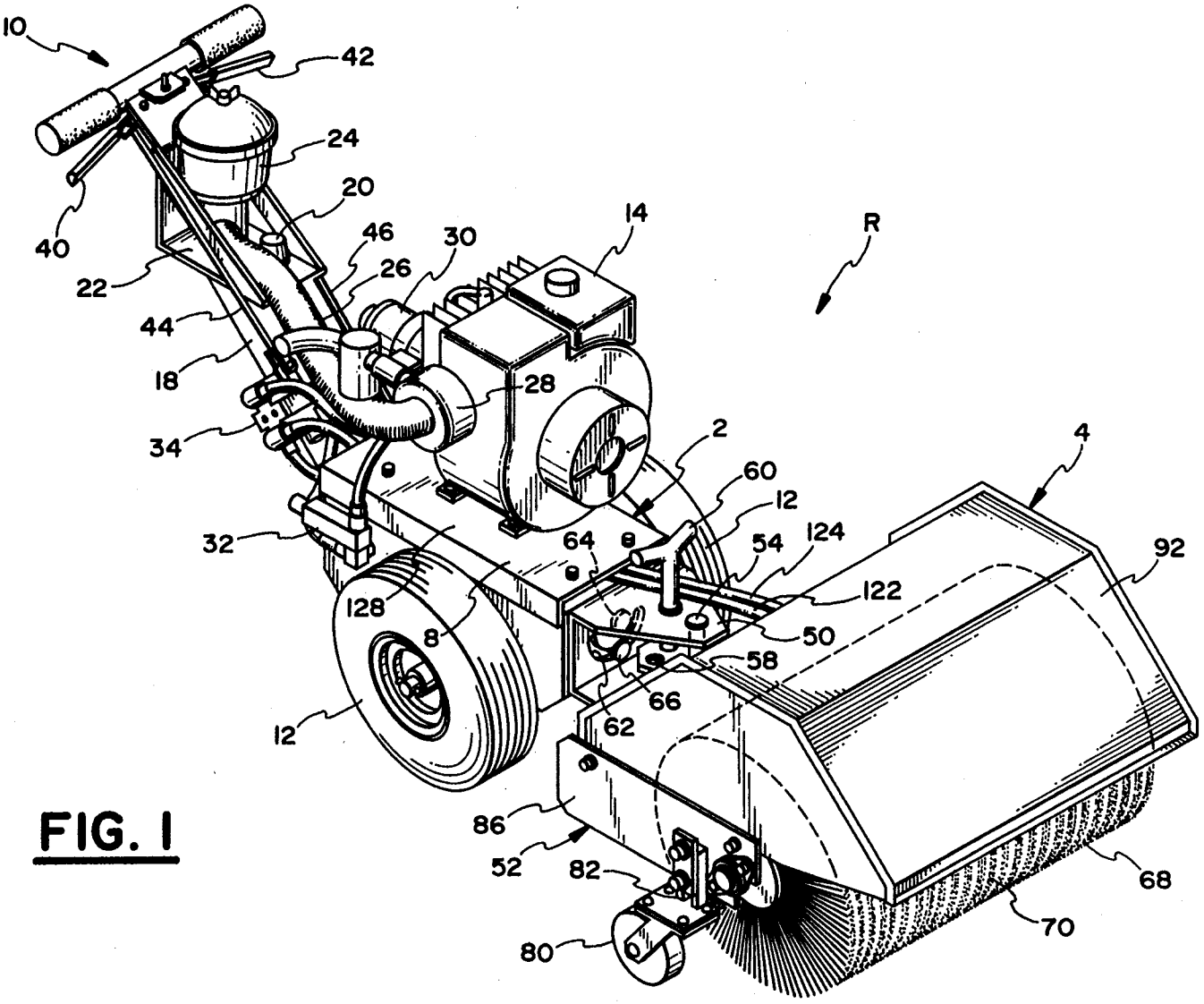
FIG. 1 is a front perspective view of a rotary sweeper in accordance with the present invention.

A walk-behind self-propelled rotary sweeper R in accordance with the present invention is disclosed in FIG. 1. The rotary sweeper R comprises a power unit 2 and a broom attachment 4, as best shown in FIG. 1.

Figure 6:
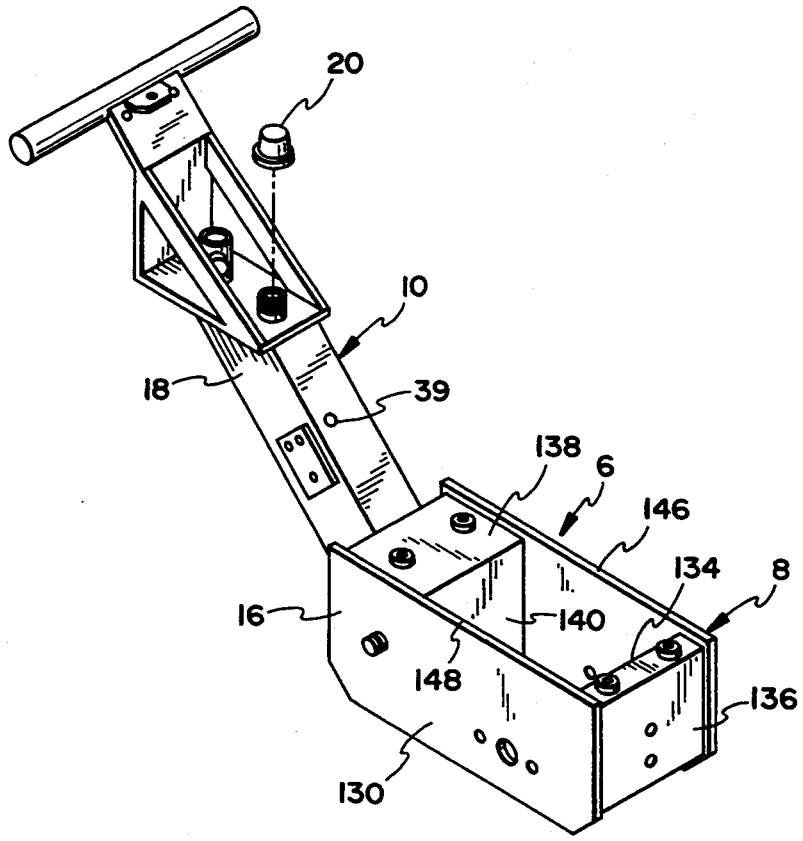
FIG. 6 is a perspective view of a unitary main frame used in thee rotary sweeper of FIG. 1.
Figure 7:
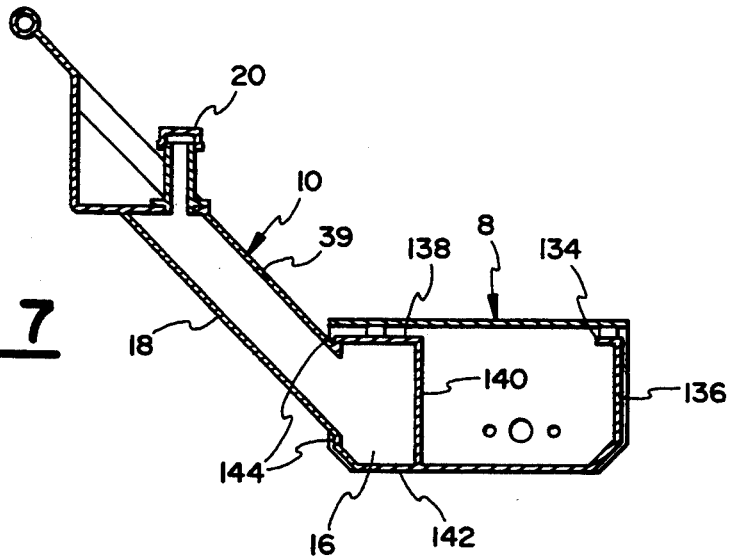
FIG. 7 is side cross-sectional view of FIG. 6.

The power unit 2 includes a main frame 6 with a base portion 8 and a T-handle portion 10. The base portion 8 is supported above the ground by a pair of drive wheels 12. An internal combustion engine 14 is supported on the base portion 8. A hydraulic oil tank 16 is integrated into the rear portion of the base portion 8, as best shown in FIGS. 6 and 7. A hollow tube 18 that communicates at one end with the tank 16 and at the other end with a filler cap 20 advantageously provides means for replenishing the hydraulic oil in the tank 16.

The T-handle portion 10 has a platform 22 connected at the upper end of the hollow tube 18 and provides support for the filler tube 20 and an air pre-cleaner 24. A hose 26 connects the air pre-cleaner 24 to an air inlet filter housing 28 of the engine 14.

A hydraulic pump 30 is advantageously directly coupled to the output shaft of the engine 14. A relief valve 32 is secured to the base portion 8. A forward/reverse valve 34 for the drive wheels 12 is secured to the hollow tube 18. A broom rotation valve 36 and an oil filter assembly 38 are secured to the hollow tube 18.

An opening 39 communicates with the inside of the hollow tube 18 for connecting to the oil filter 38 thereby to provide a return path for the oil to the storage tank 16.

Figure 3:
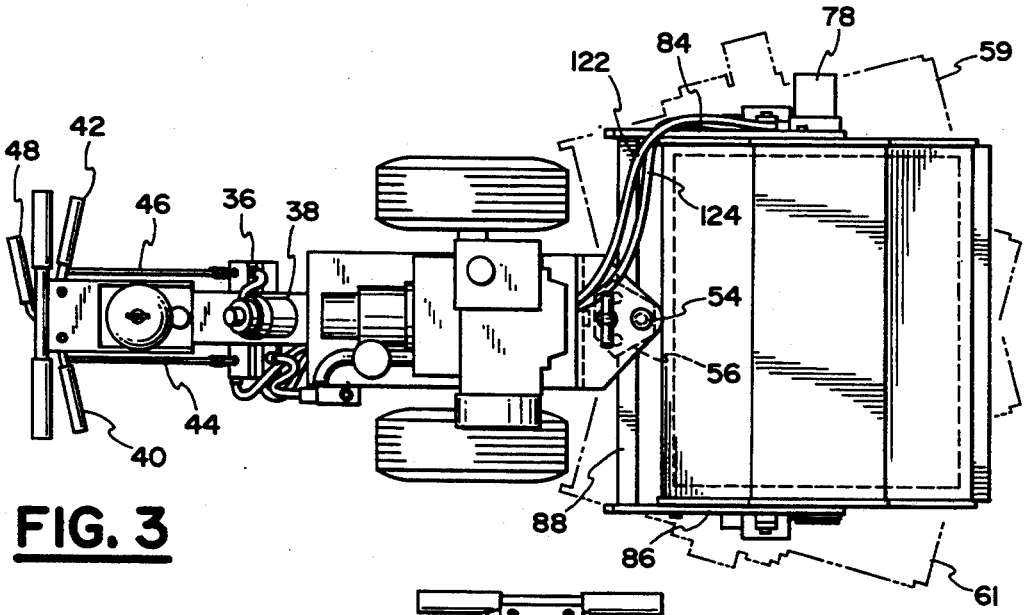
FIG. 3 is a top view of the rotary sweeper of FIG. 1.

Handgrips 40 and 42 that are operably connected to valve control rods 40 and 46, respectively, advantageously provide positive control to the valves 34 and 36, respectively, as best shown in FIGS. 1 and 3. A handgrip 48 that is operably connected to the valve control rod 44 provides for setting the valve 34 to either a forward or reverse mode, as best shown in FIG. 3. The use of the control rods 40 and 46, instead of cables, pulleys or linkages, advantageously provides for positive and reliable control of the valves.

A U-shaped broom pivot bracket 50 that is secured to the front end of the base portion 8 provides the attachment means for the broom attachment 4. The bracket 50 pivotally secures a broom mount 52 with a vertical pin 54 such that the broom mount 52 is pivotable about a vertical axis. The broom mount 52 has a pivot bracket 56 with a hole that cooperates with the pin 54. The pivot bracket 56 includes a set of holes 58 disposed on a radius from the pivot pin 56, each of which cooperates with a broom angle pin 60 to advantageously change the angle of the rotational axis of the broom attachment 4, either to the left or right, as indicated in phantom lines 59 and 61, respectively, relative to the forward direction of travel of the rotary sweeper R, as best shown in phantom lines in FIG. 3.

Figure 4:
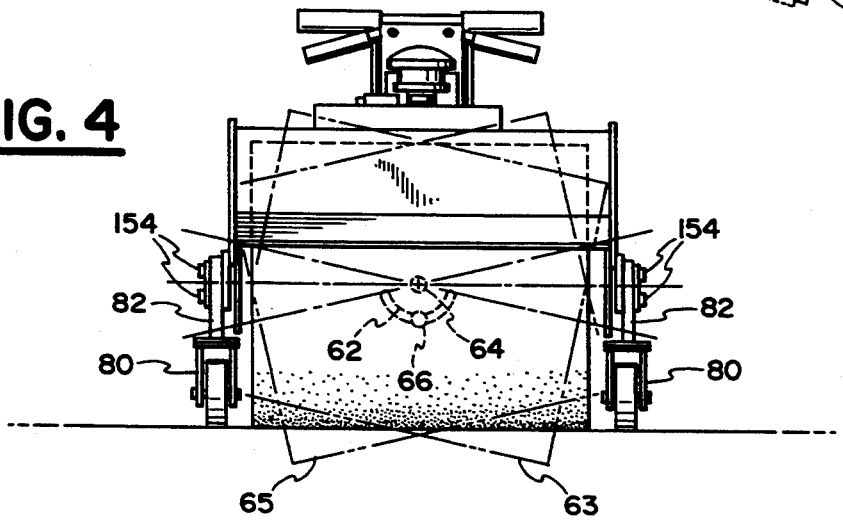
FIG. 4 is a front elevational view of the rotary sweeper of FIG. 1.

The broom pivot bracket 50 has a semi-circular arc slot 62 that cooperates with a horizontal pivot pin 64 to advantageously raise either end of the broom attachment 4, thereby to advantageously apply a differential down pressure on the ground surface, as best shown in phantom lines 63 and 65 in FIG. 4. A bolt 66 preferably locks the pivot bracket 50 at the desired angle.

Figure 8:
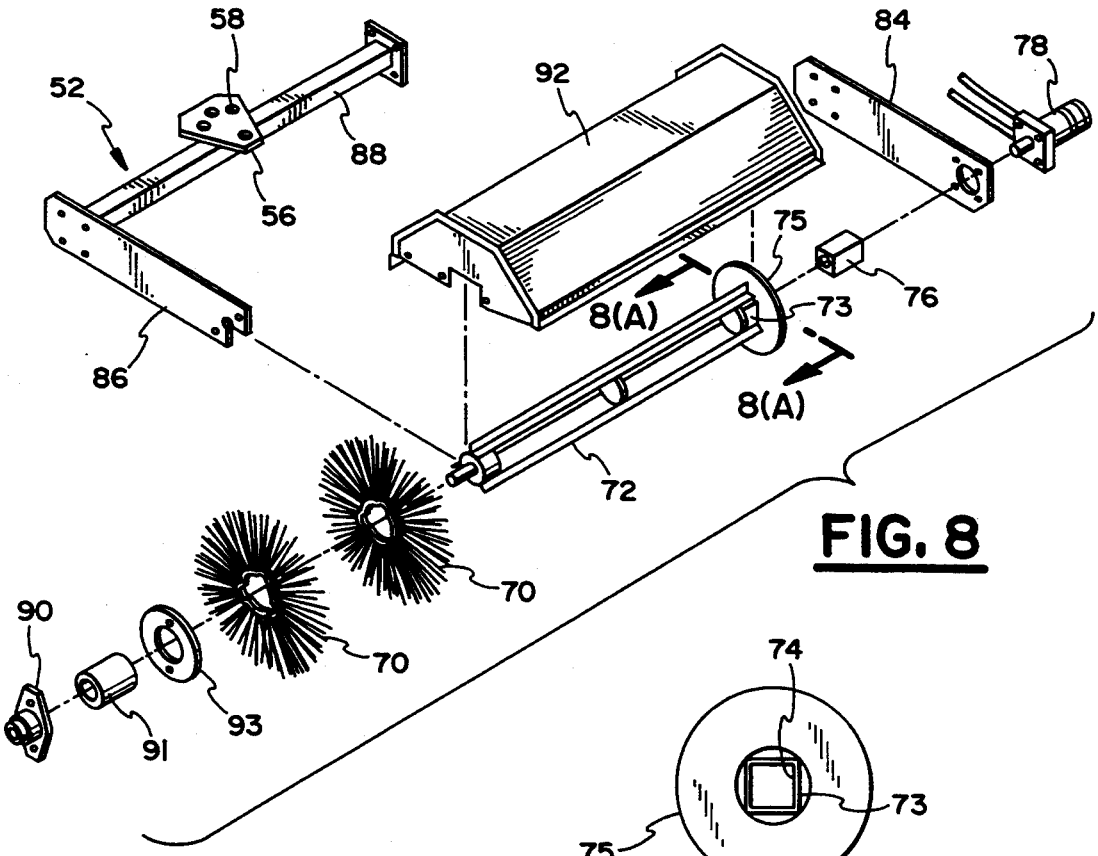
FIG. 8 is an exploded view of a rotary broom used in the rotary sweeper of FIG. 1.
Figure 8A:
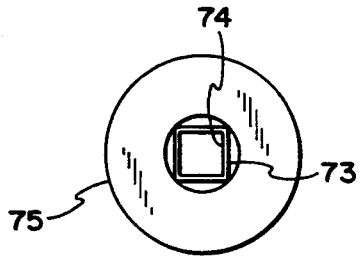
FIG. 8(A) is a view taken along line 8(A)—8(A) in FIG. 8, showing a square sleeve adapted to receive a corresponding square shaft of the drive motor of the rotary broom.

The broom attachment 4 has a rotary broom 68 that comprises a plurality of alternating polypropelene and wire broom wafers 70, as best shown in FIGS. 1 and 8. The broom wafers 70 are supported by a broom core 72, which is in turn supported by the broom mount 52. The broom core 72 at one end has preferably a square sleeve 73 with a square opening 74 which receives in loose interference fit a square shaft 76 that is connected to the broom drive motor 78. The square shaft 76 and the square opening 74 advantageously permit a positive broom drive in an abrasive dirt laden operating environment without the need of lubrication, which could collect dirt and cause excessive wear.

A pair of caster assemblies 80 with slotted mounting brackets 82 advantageously provide a downward limit on the down pressure of the broom attachment 4. The caster assemblies 80 are secured to the broom mount 52.

The broom mount 52 comprises two parallel horizontal arms 84 and 86 secure to a horizontal support 88 forming a U-shape, as best shown in FIG. 3. The arms 84 and 86 advantageously provide support to the rotary broom 68. The arm 84 is advantageously removably secured to one end of the support 88 thereby to facilitate removal and replacement of the wafers 70. An end bearing 90, bearing spacer 91 and broom core cap plate 93 are likewise removably secured to the arm 86 such that the broom 68 can be released from the mount 52.

A broom hood 92 is removably secured to the arms 84 and 86. The hood 92 advantageously provides a shield for the operator from any flying debris during a sweeping operation.

Figure 5:
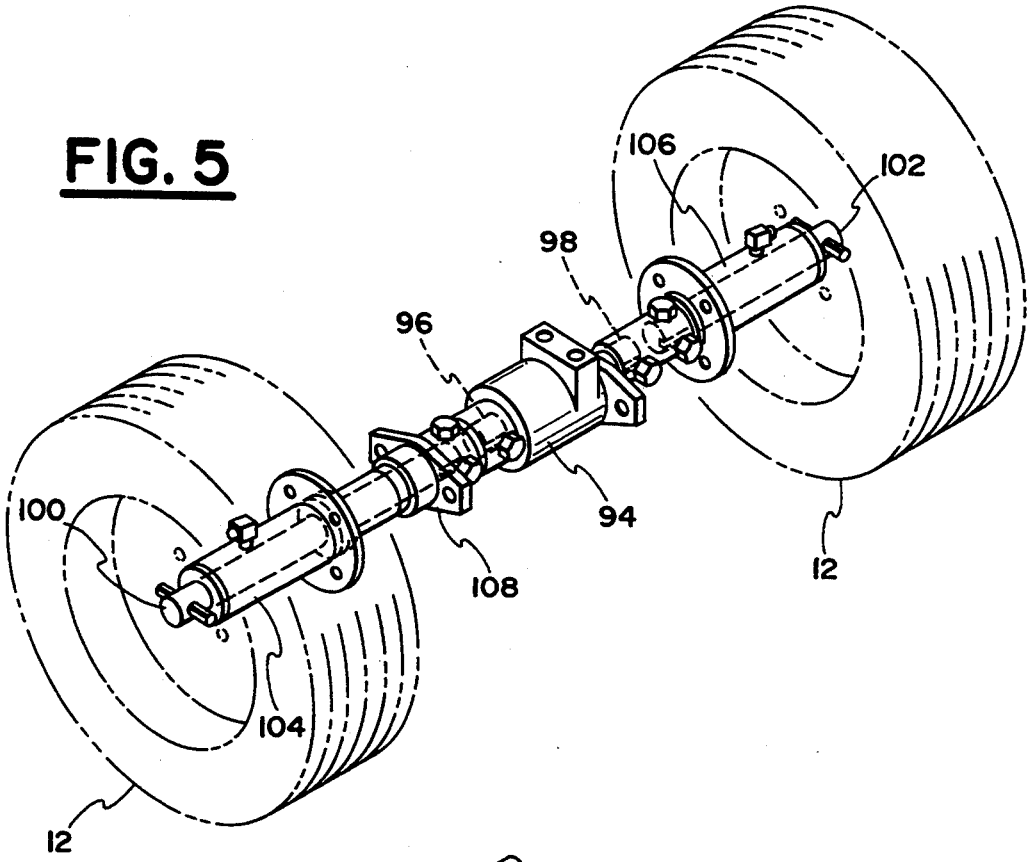
FIG. 5 is a perspective view of a wheel drive used in the rotary sweeper of FIG. 1.

The drive wheels 12 are propelled by a direct coupled hydraulic motor 94 with a through shaft with portions 96 and 98 that protrude beyond the motor housing, as best shown in FIG. 5. The shaft portions 96 and 98 are directly coupled to axles 100 and 102 which are then operably connected to wheel hub assemblies 104 and 106. The wheel hub assemblies 104 and 106 are secured to the respective wheels 12. The wheel hub assemblies 104 and 106 advantageously incorporate standard ratchet bearings (not shown) which lock up when the shaft portions 96 and 98 turn, advantageously providing a positive drive forward. The ratchet bearings are also designed to overrun the powerized axle when and if turning or steering of the rotary sweeper R is needed, thereby enabling easy steering of the machine. The axle 104 is supported by axle bearing 108. The ratchet bearings are available from Torrington Bearing (203-482-9511), Part No. RCB 162117. The hydraulic motor 94 and the axle bearing 108 are secured to the base portion 8 of the main frame 6.

Figure 9:
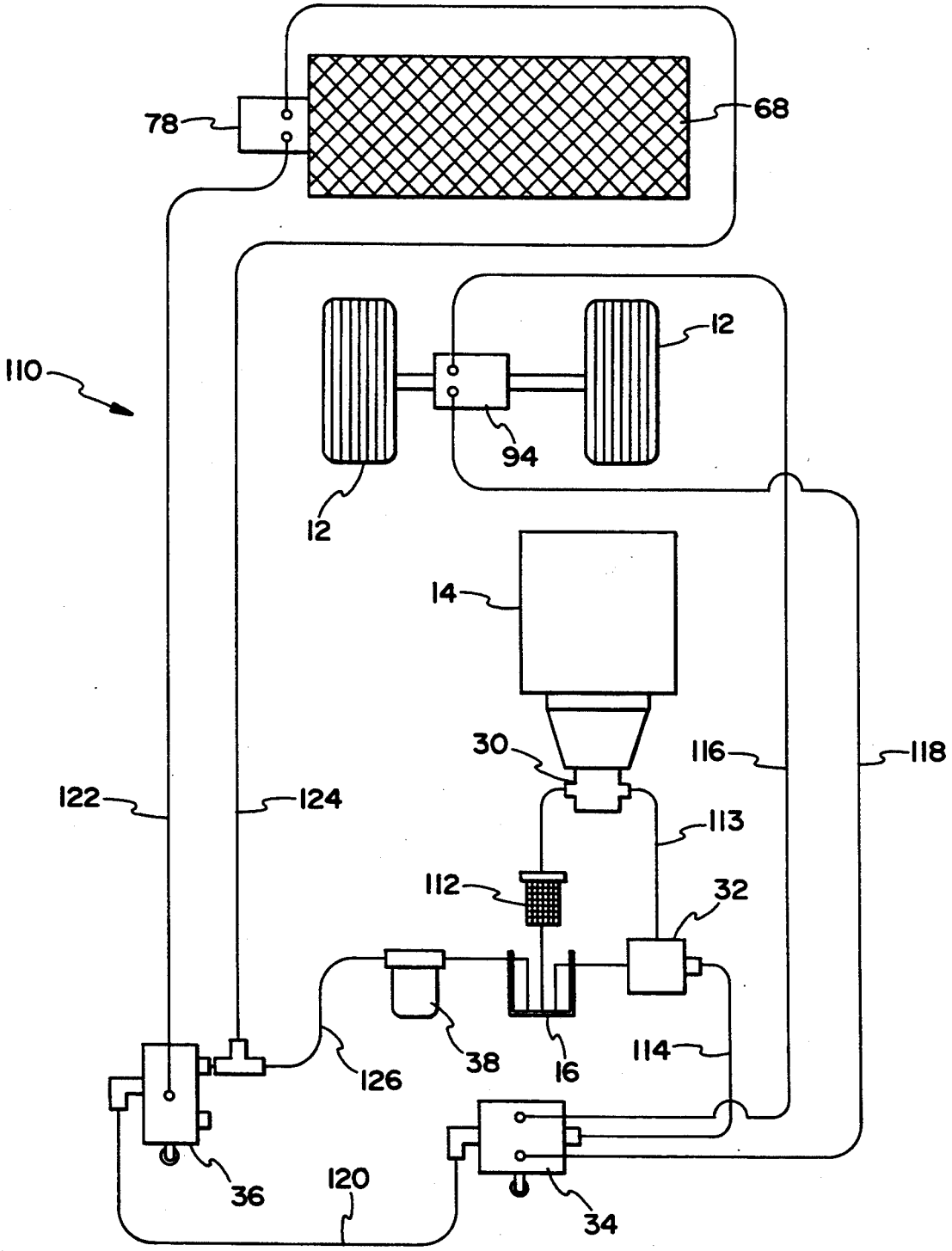
FIG. 9 is a schematic diagram of a hydraulic circuit used in the rotary sweeper of FIG. 1.

The broom hydraulic motor 78 and the wheel drive motor 94 are powered through a hydraulic circuit 110, as best shown in FIG. 9. The hydraulic pump 30 pumps pressurized oil from the hydraulic tank 16 through a tank screen 112. The pressurized hydraulic oil flows through the relief valve 32 via hose 113 and to the drive wheel valve 34 through hose 114. If the handgrip 40 is pressed, then the hydraulic oil will flow from the valve 34 to the wheel drive motor 94 through hose 116. The hydraulic oil then flows back to the valve 34 through hose 118 and then to the valve 36 through hose 120. If the handgrip 42 is pressed, the pressurized oil then will flow to the broom motor 78 through hose 122. The hydraulic oil then returns to the hydraulic tank 16 through hoses 124 and 126 through the filter 38.

If the handgrips 40 and 42 are not pressed, the pressurized oil from the tank 16 simply flows through the valves 34 and 36, without being directed to the respective hydraulic motors 94 and 78. The handgrip 40 and 42 are biased in the un-pressed position so that the hydraulic motors 78 and 94 are advantageously idle and inoperative unless the operator deliberately decides to power them.

When the handgrips 40 and 42 are unpressed, the valves 34 and 36 are in bypass mode wherein the hydraulic oil from the pump 30 bypasses the drive motors 78 and 94. The shaft of the motor 94 is locked against rotation in the reverse direction when it is not turning in the forward direction, thereby locking the drive wheels 12 in place to prevent the machine from free-rolling in reverse without any assistance from the operator. This is very advantageous when the sweeper R is on an upgoing incline and the operator wishes to stop.

The hydraulic circuit 110 is a series circuit, such that oil flows from one component to another component sequentially.

If the valve 34 is set in the reverse mode, then the pressurized oil from the valve 34 to the motor 94 will flow in the reverse direction, thereby driving the drive motor 98 in the reverse direction, which releases the ratchet bearings and allows the machine to be moved reverse by hand.

The engine 14 is supported on an engine mount 128 that is removably secured to the base portion 8 of the main frame 6. The removability of the engine mount 128 advantageously provides for access to the drive motor 94 disposed within the base portion 8.

The base portion 8 of the main frame 6 comprises a pair of parallel spaced apart side plates 130 and 132 and secured together by horizontal plates 134, 138 and 142 and by vertical plates 136, 140 and 144, as best shown in FIGS. 6 and 7. The horizontal top plates 134 and 138 are advantageously disposed below the top edges 146 and 148 of the side plates 130 and 132. When the engine mount 128 is secured to the base porion 8, as best shown in FIG. 1, a gap is formed between the bottom surface of the engine mount 128 and the horizontal plates 138 and 134 to advantageously provide a passageway for the hoses 116 and 118 for the drive wheel motor 94 and the hoses 122 and 124 for the broom motor 78.

A person of ordinary skill in the art will therefore appreciate that the main frame 6 is a rigid and compact structure for providing an integrated support frame for the various components of the power unit 2.

While the present invention is disclosed with a sweeper attachment, it should be understood that other attachments that can be used with the power unit 2.

Operation

In operation, the rotary sweeper R is operated by turning on the engine 14 to pressurize the hydraulic circuit 110. If the operator decides to sweep with the axis of rotation of the rotary broom 68 transverse to the direction of travel of the rotary sweeper R, then the angle pin 60 is disposed through one of the holes 58 which is centrally positioned. If the operator wishes to angle the rotary broom either to the left or to the right, as generally shown by the phantom lines 59 and 61 in FIG. 3, then the angle pin 60 is positioned in one of the outer holes 58. The pin 60 is advantageously biased by spring 152 in the downward direction to prevent the pin from accidentally disengaging from the bracket 56.

If the operator decides to operate the rotary broom 68 in an inclined positions, as generally indicated by the phantom lines 63 and 65 in FIG. 4, the bolt 66 is loosened and the rotary broom is rotated about the pin 64 until the desire position is obtained, after which the bolt 66 is tightened. The casters 80 may be adjusted by loosening the mounting bolts 154 and adjusting vertically the respective slotted mounting brackets 82, after which the mounting bolts 154 are tightened.

Figure 2:
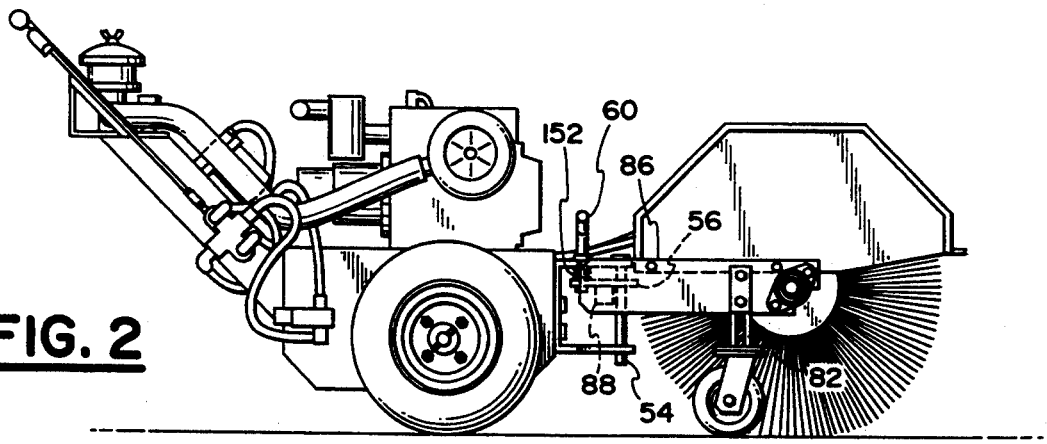
FIG. 2 is a side elevational view of the rotary sweeper of FIG. 1.

To start sweeping, the operator would be positioned behind the handle portion 10. The operator then checks the handgrip 48 to ensure that it is positioned such that the wheel drive valve 34 is in the forward mode. The handgrips 40 and 42 are then squeezed toward the operator, thereby permitting the hydraulic fluid to flow to the respective drive motors 94 and 78 and causing the drive wheels 12 to turn in the forward direction and the rotary broom in the counter-clockwise direction, as viewed in FIG. 2. Thus, the wheels 12 and the broom 68 rotate in opposite directions, advantageously providing stability during operation. The operator may vary the speed of the drive wheels 12 by varying the gripping pressure on the handgrip 40.

If the operator decides to stop the rotary sweeper R, the operator merely releases the grip on the handgrips 40 and 42, which causes the handgrips to return to their original biased position, wherein the valves 34 and 36 return to their bypass or normal positions, cutting off the flow of hydraulic fluid to the motors 94 and 78. At this point, the wheels 12 are locked in place against reverse rotation by the shaft of motor 94 and will therefore not free-roll in the reverse direction.

If the operator wishes to sweep in place, the handgrip 42 would be squeezed, while keeping the handgrip 40 in its normal position. This causes the hydraulic fluid to flow to the drive motor 78 that drives the rotary broom 68, without activating the drive motor 94 for the drive wheels 12.

If the operator wishes to move the machine backwards, the handgrip 48 would be pulled backwards such that the valve 34 is positioned in the reverse mode, thereby automatically causing hydraulic fluid to flow to the motor 94, which would then turn in the reverse direction to over-ride the ratchet bearing.

To adjust the down pressure on the rotary broom 68, the casters 80 are adjusted vertically as discussed above.

To replace the broom 68, the operator merely removes the arm 84 from the support 88 and pulls the square shaft 76 from the square sleeve 73, as best shown in FIG. 8. The bolts (not shown) securing bearing 90 are removed from the other end of the broom core 72, thereby freeing the broom 68 from its mount 52. The broom core cap plate 75 is slipped off from the end of core 72, allowing the broom wafers 70 to be removed and replaced at that end.

To replace the broom attachment 4 with another attachment, the mount 52 is disengaged from the bracket 50 by removing the pins 54 and 60. The drive motor 78 is also removed from the arm 84 by removing its mounting bolts (not shown) and withdrawing the shaft 76 from the sleeve 73. The other attachment is then ready to be hooked up.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. A walk-behind self-propelled device, comprising:

a) a main frame including a base portion and a handle portion;

b) a pair of wheels secured to said base portion for engaging the ground surface;

c) an engine mounted on said base portion;

d) a hydraulic pump carried by said base portion and operably connected to said engine;

e) a first hydraulic motor directly coupled to said wheels and operably connected to said hydraulic pump;

f) an attachment secured to said base portion;

g) a second hydraulic motor directly coupled to said attachment and operably connected to said hydraulic pump;

h) first and second valves for controlling said first and second hydraulic motors, respectively;

i) each of said first and second valves having a bypass position whereby hydraulic fluid bypasses said first and second hydraulic motors;

j) first and second handle grips operably associated with said handle portion and said first and second valves, respectively, said handle grips having non-operative positions corresponding with said first and second valves being in said bypass positions; and k) said first and second handle grips being normally biased in said non-operative positions of said valves.

2. A device as in claim 1, wherein:

a) first and second control rods operably secured to said first and second valves, respectively; and b) said first and second handle grips operably connected to said first and second control rods.

3. A device as in claim 1, wherein:

a) said base portion includes an integrated hydraulic tank.

4. A device as in claim 3, wherein:

a) said handle portion is hollow and communicates with said tank; and b) a filler cap is disposed at an upper end of said handle portion.

5. A device as in claim 3, wherein:

a) said base portion includes a pair of spaced apart plates; and b) said tank is disposed between said plates.

6. A device as in claim 1, and further comprising:

a) a pre-cleaner disposed on said handle portion and operably connected to said engine.

7. A device as in claim 1, wherein:

a) said first valve includes forward and reverse positions for causing said first motor in the forward or reverse direction, respectively.

8. A device as in claim 1, wherein:

a) said first valve is secured to said handle portion.

9. A device as in claim 8, wherein:

a) said second valve is secured to said handle portion.

10. A device as in claim 1, wherein:

a) said base portion includes a pair of spaced apart plates; and b) said first motor is disposed between said plates.

11. A device as in claim 1, wherein:

a) said attachment is a rotary broom.

12. A device as in claim 11, and further comprising:

a) an attachment bracket secured to said base portion and said rotary broom.

13. A device as in claim 12, wherein:

a) said attachment bracket includes means for angling said rotary broom about a vertical axis.

14. A device as in claim 13, wherein:

a) said rotary broom has a longitudinal axis; and b) said attachment bracket includes means for angling said rotary broom about a horizontal axis transverse to the longitudinal axis.

15. A device as in claim 11, and further comprising:

a) a pair of vertically adjustable wheels each disposed on respective end of said rotary broom thereby to provide limit on the engagement of said rotary broom with the ground.

16. A walk-behind self-propelled drive for powering an attachment, comprising:

a) a main frame including a base portion and a handle portion;

b) a pair of drive wheels supporting said base frame;

c) means for connecting said main frame to an attachment;

d) hydraulic drive carried by said main frame and operably connected to said drive wheels and the attachment;

e) said base portion including an integrated hydraulic tank for supplying hydraulic oil to said hydraulic drive;

f) said handle portion including a hollow member connected to said base portion and extending upwardly therefrom and communicating with said tank; and g) said hollow member including a first opening for replacing hydraulic oil into said tank.

17. A device as in claim 16, wherein:

a) said base portion includes a pair of space apart plates; and b) said integrated tank is disposed between said plates.

18. A device as in claim 16, wherein:

a) said hollow member includes a second opening; and b) an oil filter is secured to said hollow member and communicates with said second opening such that return oil flows through said oil filter and said second opening into said hollow member and into said tank.

19. A device as in claim 16, wherein:

a) said drive includes an internal combustion engine having an air cleaner; and b) an air pre-cleaner disposed on said handle portion away from the attachment and operably connected to said air cleaner.

20. A device as in claim 16, wherein:

a) said hydraulic drive includes a first drive motor for said wheels, second drive motor for the attachment, a first valve for controlling said first drive motor, and a second valve for controlling said second drive motor.

21. A device as in claim 20, wherein:

a) said drive includes an internal combustion engine carried by said base portion;

b) a hydraulic pump directly coupled to said engine; and c) said pump is operably connected to said first and second drive motors.

22. A device as in claim 21, wherein:

a) said first and second valves are each normally biased in a bypass position such said first and second motors are bypassed by the hydraulic oil from said pump.

23. A walk-behind self-propelled rotary sweeper, comprising:

a) a main frame including a base portion and a handle portion;

b) a pair of wheels secured to said base portion for engaging the ground surface;

c) an engine mounted on said base portion;

d) a hydraulic pump directly connected to said engine;

e) a first hydraulic motor directly coupled to said wheels and operably connected to said hydraulic pump;

f) a rotary sweeper secured to said base portion;

g) a second hydraulic motor directly coupled to said rotary sweeper and operably connected to said hydraulic pump; and h) means for selectively tilting and angling said rotary sweeper about horizontal and vertical axes, respectively.

24. A rotary sweeper as in claim 23, wherein:

a) said tilting and angling means includes a first bracket selectively pivotably secured to said base portion about the horizontal axis; and b) said rotary sweeper includes a second bracket selectively pivotably secured to said first bracket about the vertical axis.

25. A rotary sweeper as in claim 23, wherein:

a) said second motor includes a square shaft; and b) said rotary broom includes a core having a square recess adapted to receive said square shaft thereby to provide positive connection between said second motor and said rotary broom.

26. A rotary sweeper as in claim 23, wherein:

a) said second motor is removably secured to said rotary broom.

27. A rotary sweeper as in claim 23, and further comprising:

a) pair of casters each of which is disposed on respective ends of said broom assembly.

28. A walk-behind self-propelled device, comprising:

a) a main frame including a handle portion for a walking operator to be positioned behind thereof;

b) a pair of wheels secured to said base portion for engaging the ground surface;

c) a first hydraulic drive motor directly coupled to said wheels;

d) an attachment secured to said frame;

e) a second hydraulic drive motor directly coupled to said attachment;

f) first and second control valves for independently controlling said first and second drive motors, respectively, such that said drive wheels and said attachment are activated independently g) each of said first and second valves having a bypass position whereby hydraulic fluid bypasses said first and second hydraulic motors;

h) first and second handle grips operably associated with said handle portion and said first and second valves, respectively, said handle grips having non-operative positions corresponding with said first and second valves being in said bypass positions; and i) said first and second handle grips being normally biased in said non-operative positions of said valves.

* * * * *